US005216814A

United States Patent [19]

McGregor

[11] Patent Number: 5,216,814

[45] Date of Patent: Jun. 8, 1993

[54] CHAIN SAW GUIDE BAR

[75] Inventor: Gavin McGregor, Gloucester, Canada

[73] Assignee: National Research Council of Canada, Ottawa, Canada

[21] Appl. No.: 853,048

[22] Filed: Mar. 18, 1992

[30] Foreign Application Priority Data

Mar. 18, 1991 [CA] Canada ..... 2038492

[51] Int. Cl.[5] ..... B27B 17/02

[52] U.S. Cl. ..... 30/387; 30/123.4

[58] Field of Search ..... 30/387, 382, 383, 123.4; 83/821; 76/112

[56] References Cited

U.S. PATENT DOCUMENTS 2,962,061 11/1960 Nielsen ..... 30/123.4

4,138,813 2/1979 Harada et al. ..... 30/387

4,393,590 7/1983 Pantzar ..... 30/387

5,050,303 9/1991 Sinclair et al. ..... 30/123.4

5,056,224 10/1991 Seigneur ..... 30/382

*Primary Examiner*—Frank T. Yost

*Assistant Examiner*—Hwei-Sui Payer

[57] ABSTRACT

A chain saw guide bar comprises an elongate plate member having a rounded tip and providing guide means for a saw chain around its periphery. The plate member has a network of intercommunicating passageways provided between its lateral faces and extending between multiple points on its upper and lower periphery so as to permit the flow of fluid therebetween. This arrangement provides efficient transfer of lubricant or other medium to all points on the guide bar periphery and can be up to 30% lighter than conventional designs.

11 Claims, 1 Drawing Sheet

CHAIN SAW GUIDE BAR

BACKGROUND OF THE INVENTION

1. Field of the Invention

This invention relates to chain saws, and more particularly to a chain saw guide bar.

2. Description of the Prior Art

A chain saw consists of a motor, usually a small internal combustion engine, and an elongate protruding support member, known as a guide bar, around which the saw chain is driven. Some means must be provided to lubricate and cool the saw chain as it travels around the guide bar, and this is normally achieved by supplying oil to the chain as it leaves the motor housing. The chain moves in a direction such that it travels first along the upper part of the guide bar, and this creates a problem in carrying oil to the lower part of the guide bar, since by this time, even when the chain is initially flooded with oil, very little oil remains. The rest is dispersed into the atmosphere.

A further problem arises at the rounded tip of the guide bar. Normally sprockets are employed to guide the chain, and grease or oil must be applied via a small lubrication hole. If the sprocket bearings are not adequately lubricated, they will overheat and fail, generally without warning. With heavy use, the lubrication hole tends to become plugged with sawdust, and the user will often fail to apply the necessary lubricants, with disastrous consequences.

Since chain saws are generally intended to be hand operated, weight is also an important factor. A chain saw necessarily has to be operated with the bar cantilevered outward, and operator fatigue can be a serious problem. Weight can also be an important factor in some large mechanical saws. In the case of the most modern saws, designed to cut concrete and other relatively hard materials, the flow of coolant, normally water, is essential not only to cool the chain, but also to flush concrete, cement or other material from the chain to prevent excessive wear. This problem limits the viability of these modern tools.

Attempts have been made to address the above problems, and generally saw bars are made either in one piece with a guide groove for the chain machined into the bar, or in three pieces, with a center plate being recessed relative to the outer plates to provide the groove. The three parts are spot welded onto the bar.

In most prior art lubricating systems, attempts have been made to modify the chain groove to serve also as a circumferential oil channel. However, this arrangement suffers from the disadvantages outlined above. U.S. Pat. No. 3,578,779 is typical of such an arrangement.

U.S. Pat. No. 4,819,332 describes a chain saw guide bar with a through hole in the guide plate to which oil is supplied. Connection channels extend from the through hole to the chain saw guide grooves. While providing some improvement this arrangement does not significantly overcome the problems outlined above.

SUMMARY OF THE INVENTION

According to the present invention there is provided a chain saw guide bar comprising an elongate plate member having a rounded tip and providing guide means for a saw chain around its periphery, said plate member having a network of intercommunicating passageways provided between its lateral faces and extending between multiple points on its upper and lower periphery so as to permit the flow of fluid therebetween.

As the saw chain travels around the guide bar, oil or coolant supply from the motor housing floods the network of passageways, thereby reaching all points on the periphery of the guide bar. Not only does the network of passageways significantly lighten the guide bar, due to the reduced amount of solid material, but since the guide bar itself is essentially filled with oil at all times, it maintains the guide bar cool. The preferred method of forming the network of passageways is to juxtapose two plates with raised contact areas and secure the plates together at the points of contact by brazing, spot welding, adhesives or the like. The raised contact areas preferably form an identifiable pattern, such as triangles, rectangles and the like.

If desired, capillary tubes can be provided within the passageways to ensure the precise supply of oil or coolant to, for example, sprockets at the end of the bar.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
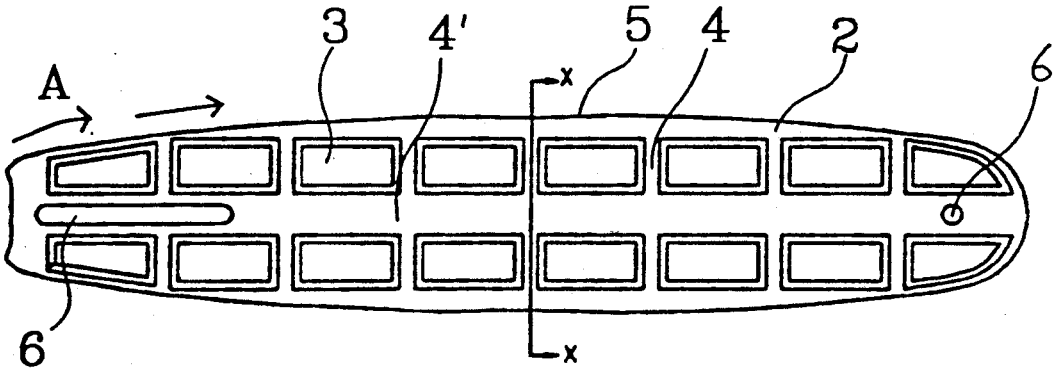
FIG. 1 is side elevation of a chain saw bar made in accordance with the invention.
Figure 2:
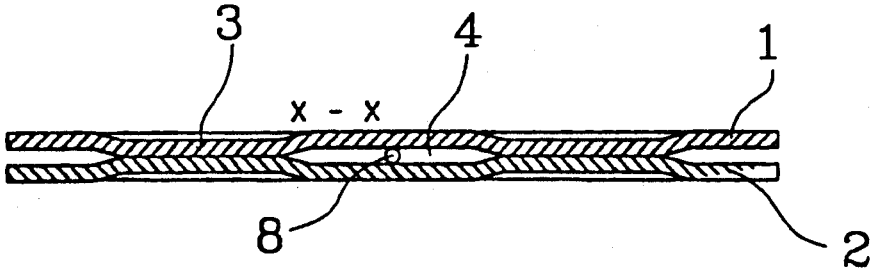
FIG. 2 is a section taken along the line X—X in FIG. 1.

As shown in FIGS. 1 and 2, the chain saw bar consists of two juxtaposed, elongate matching plates 1, 2 with a rounded tip.

The plates are made of pressed steel, and each is formed with a pattern of complementary raised rectangles 3 defining contact areas.

The plates, 1, 2 are juxtaposed so that the raised contact areas 3 are brought into contact, thereby defining between them a network of intercommunicating passageways 4. The contact areas can be joined together by spot welding, brazing, the use of adhesives or any other suitable joining technique.

The periphery 5 of the guide bar formed by the juxtaposed plates 1, 2 forms the guide rail for the saw chain (not shown). The chain saw guide bar is provided with transverse aperture 6 to facilitate attachment to the chain saw housing in a conventional manner.

In operation, the saw chain is driven around the periphery 5 of the guide bar in the direction shown by arrows A in a conventional manner. As the chain saw leaves the motor housing (not shown), a controlled amount of lubricant is supplied to the chain. The lubricant then flows into the network of passageways 4 formed between the raised contact areas 3. As a result, the passageways become flooded with oil, which flows out at the periphery of the guide bar along its lower edge and at the rounded tip. By appropriately choosing the size of the passageways between the raised contact areas, the resistance to oil flow throughout various parts of the guide bar can be predetermined during manufacture so as to ensure uniformity of oil flow to the periphery of the guide bar. It will be noted that central trunk passageway 4' is wider than the lateral branch passageways so as to reduce the resistance to oil flowing longitudinally along the bar.

The above design can lead the lubricant to where it is most needed, particularly along the bottom guide rails, the tip and sprocket bearings of the guide bar. The amount of lubricant reaching these points can be precisely controlled thereby minimizing wear on the parts and thus prolonging time between saw chain changes. Additionally, excess lubricant is prevented from being dispersed into the environment with the consequential environmental benefits.

While the operation of the chain saw bar has been described with oil as a lubricant, it will be understood that other fluids can be used as a transport medium. For instance, in the case of chain saws for cutting concrete, water can be used, and in this case the constant flow of water out of the network of passageways not only cools the cutting edges, but also serves to remove chippings and cement. Other fluids, such as insecticides or sealants for treating stumps or cut tree limbs, can also be introduced into the cutting zone with the described guide bar.

Where precise directional control is required, capillary tubes 8 may be inserted into passageways 4 prior to assembly of the plates 1, 2. The capillary tubes 8 can lead the fluid to a particular point on the periphery of the guide bar, such as a sprocket, for example.

Figure 3:
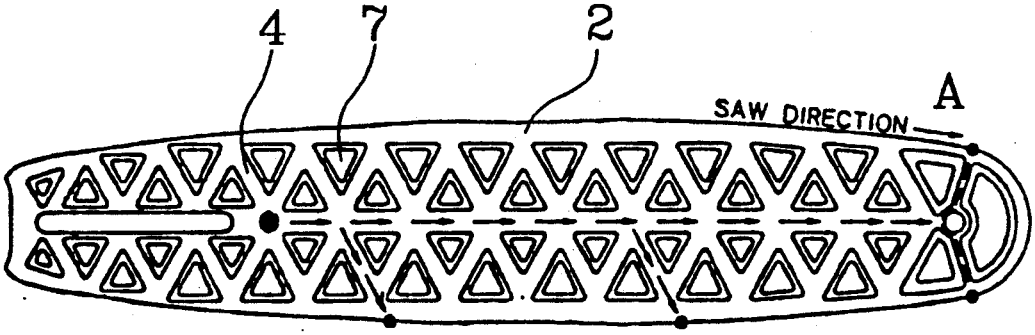
FIG. 3 is a side elevation of a second embodiment of a chain saw bar in accordance with the invention.

FIG. 3 shows a second embodiment of the invention. The embodiment of FIG. 3 is similar to the embodiment shown in FIGS. 1 and 2 except for the fact that the raised contact areas are provided by a pattern of overlapping triangles 7, which define between them the network of passageways 4.

The described chain saw bar is easy to make and is approximately 30% lighter than conventional chain saw bars. It also involves fewer manufacturing steps than prior art designs. The flow of coolant or lubricant throughout the chain saw bar provides good cooling, flushing of chippings and the like.

The chain saw bar has been described as an assembly of two juxtaposed plates, which is the preferred embodiment of the invention. The bar conceivably could be cast with a network of passageways, using for example the lost wax process, although such a process is likely to be more expensive.

I claim:

1. A chain saw guide bar comprising:

a) an elongate plate member consisting of at least two mutually joined juxtaposed plates, said plate member having a rounded tip and providing guide means for a saw chain around its periphery; and b) a plurality of mutually separated spacer means between said juxtaposed plates, said spacer means defining therearound and between said juxtaposed plates a network of intercommunicating passageways extending between multiple points on upper and lower periphery portions of said elongate plate member so as to permit the free flow of fluid between any of said multiple points.

2. A chain saw guide bar according to claim 1, wherein said spacer means comprise raised complementary contact surfaces on said plates where they are joined together.

3. A chain saw guide bar according to claim 2, wherein said plates are joined together at said raised contact surfaces by brazing.

4. A chain saw guide bar according to claim 3, wherein said plates are joined together at said raised contact surfaces by an adhesive.

5. A chain saw guide bar according to any one of claims 2 to 4, wherein said raised contact surfaces define a regular pattern.

6. A chain saw guide bar according to claim 5, wherein said regular pattern consists of a plurality of triangles.

7. A chain saw guide bar according to claim 5, wherein said regular pattern consists of a plurality of rectangles.

8. A chain saw guide bar as claimed in claim 7, wherein said network of passageways includes a central longitudinal passageway of greater width than branch passageways extending therefrom to said multiple points on the periphery of the elongate plate member.

9. A chain saw guide bar comprising an elongate plate member having a rounded tip and providing guide means for a saw chain around its periphery, said plate member having a network of intercommunicating passageways provided between its lateral faces and extending between multiple points on its upper and lower periphery so as to permit the flow of fluid therebetween, said plate member comprising at least two juxtaposed plates joined together, said plates being provided with spacer means therebetween and around which the passageways are formed, said spacer means comprising raised complementary contact surfaces on said plates where they are joined together, said raised contact surfaces defining a regular pattern, and capillary tubes located in selected passageways so as to provide precise control of fluid flow to selected points on the periphery of the plate member.

10. A chain saw guide bar comprising;

a) an elongate plate member consisting of at least two mutually joined juxtaposed plates, said plate member having a rounded tip and providing guide means for a saw chain around its periphery; and b) a plurality of mutually separated spacer means between said juxtaposed plates defining a network of intercommunicating passageways extending between multiple points on upper and lower peripheral portions of said elongate plate member so as to permit the free flow of fluid between any of said multiple points; and c) capillary tubes located in selected passageways in said network so as to provide precise control of fluid flow to selected points on the periphery of the plate member.

11. A guide bar for a chain saw comprising:

a) an elongate plate member consisting of at least two mutually joined juxtaposed plates, said plate member having a rounded tip and providing guide means for a saw chain around its periphery; and b) a plurality of mutually separated spacer means arranged in a regular pattern of overlapping triangles between said juxtaposed plates, said spacer means defining therearound and between said juxtaposed plates a network of intercommunicating passageways extending between multiple points on upper and lower peripheral portions of said elongate plate member so as to permit the free flow of fluid between any of said multiple points.

* * * * *